US007013980B2

(12) United States Patent
Purkis et al.

(10) Patent No.: US 7,013,980 B2
(45) Date of Patent: Mar. 21, 2006

(54) HYDRAULICALLY ACTUATED CONTROL SYSTEM FOR USE IN A SUBTERRANEAN WELL

(75) Inventors: Daniel G. Purkis, Cruden Bay (GB); Alfred R. Curington, The Woodlands, TX (US)

(73) Assignee: WellDynamics, Inc., Spring, TX (US)

( * ) Notice: Subject to any disclaimer, the term of this patent is extended or adjusted under 35 U.S.C. 154(b) by 223 days.

(21) Appl. No.: 10/643,488

(22) Filed: Aug. 19, 2003

(65) Prior Publication Data

US 2005/0039914 A1 Feb. 24, 2005

(51) Int. Cl.
*E21B 7/12* (2006.01)
*E21B 34/10* (2006.01)

(52) U.S. Cl. ..... 166/386; 166/319; 166/336

(58) Field of Classification Search ..... 166/369, 166/370, 373, 374, 316, 324, 332.1, 332.7
See application file for complete search history.

(56) References Cited

U.S. PATENT DOCUMENTS

| | | | | |
|---|---|---|---|---|
| 2,770,308 | A | 11/1956 | Saurenman | |
| 3,763,885 | A | 10/1973 | Sussman | |
| 4,132,205 | A | 1/1979 | Merritt | |
| 4,180,239 | A | 12/1979 | Valukis | |
| 4,915,168 | A * | 4/1990 | Upchurch | 166/250.15 |
| 5,238,070 | A | 8/1993 | Schultz et al. | |
| 5,564,501 | A | 10/1996 | Strattan et al. | |
| 5,746,413 | A | 5/1998 | Goloff | |
| 5,897,095 | A | 4/1999 | Hickey | |
| 5,906,220 | A | 5/1999 | Thompson | |
| 6,253,857 | B1 * | 7/2001 | Gano | 166/386 |
| 6,276,458 | B1 | 8/2001 | Malone | |
| 6,585,051 | B1 | 7/2003 | Purkis et al. | |
| 2001/0037884 | A1 | 11/2001 | Schultz et al. | |

FOREIGN PATENT DOCUMENTS

| | | |
|---|---|---|
| FR | 2270458 | 5/1975 |
| GB | 1135895 | 12/1968 |
| GB | 1345867 | 2/1974 |
| GB | 2335216 | 9/1999 |

OTHER PUBLICATIONS

Search Report for PCT/US04/21934.

* cited by examiner

*Primary Examiner*—Frank S. Tsay
(74) *Attorney, Agent, or Firm*—Konneker & Smith, P.C.

(57) ABSTRACT

A control system for use in controlling actuation of tools in a subterranean well. In a described embodiment, a control system includes a well tool, an actuator for the well tool and a control module interconnected between the actuator and first and second fluid lines. The control module is operative to meter a predetermined volume of fluid from the actuator to the second line in response to pressure applied to the first line.

29 Claims, 5 Drawing Sheets

HYDRAULICALLY ACTUATED CONTROL SYSTEM FOR USE IN A SUBTERRANEAN WELL

BACKGROUND

The present invention relates generally to operations performed and equipment utilized in conjunction with subterranean wells and, in an embodiment described herein, more particularly provides a hydraulically actuated control system.

It is very desirable to be able to control operation of well tools from a remote location, such as the earth's surface or another location in a well. For example, it would be desirable to be able to control the flow rate of fluids through a downhole valve or choke. This would enable precise production (or injection) rate control without the need to intervene into the completion.

Some control systems have been proposed for this purpose in the past. However, for the most part such control systems are inordinately complex and, therefore, unreliable, expensive and/or difficult to construct, maintain, calibrate, etc.

What is needed is a control system which has reduced complexity and increased reliability, and which permits accurate control over actuation of well tools in a downhole environment.

SUMMARY

In carrying out the principles of the present invention, in accordance with an embodiment thereof, a control system is provided which utilizes a control module connected to an actuator for a well tool. Repeated applications of pressure to a fluid line causes the control module to repeatedly meter a known volume of fluid from the actuator to a second fluid line. As each metered volume of fluid is displaced from the actuator to the second fluid line, the actuator incrementally actuates the well tool.

In one aspect of the invention, a control system for use in a subterranean well is provided. The system includes a well tool, an actuator for the well tool and a control module interconnected between the actuator and first and second fluid lines. The control module is operative to meter a predetermined volume of fluid from the actuator to the second line in response to pressure applied to the first line.

In another aspect of the invention, another control system for use in a subterranean well is provided. The system includes a well tool, an actuator including an actuator piston which displaces to operate the well tool, and a control module interconnected between the actuator and first and second fluid lines. Pressure applied to the first line displaces the actuator piston and operates the well tool. The control module meters a predetermined volume of fluid from the actuator to the second line, to thereby limit displacement of the actuator piston in response to each of multiple applications of pressure to the first line.

In yet another aspect of the invention, a method of controlling actuation of a well tool is provided. The method includes the steps of: interconnecting a control module between first and second fluid lines and an actuator of the well tool; applying pressure to the first line, the control module transmitting pressure applied to the first line to the actuator; metering a predetermined volume of fluid from the actuator to the second line via the control module in response to the pressure applying step, thereby incrementally actuating the well tool; and repeating the pressure applying and metering steps, thereby successively incrementally actuating the well tool.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
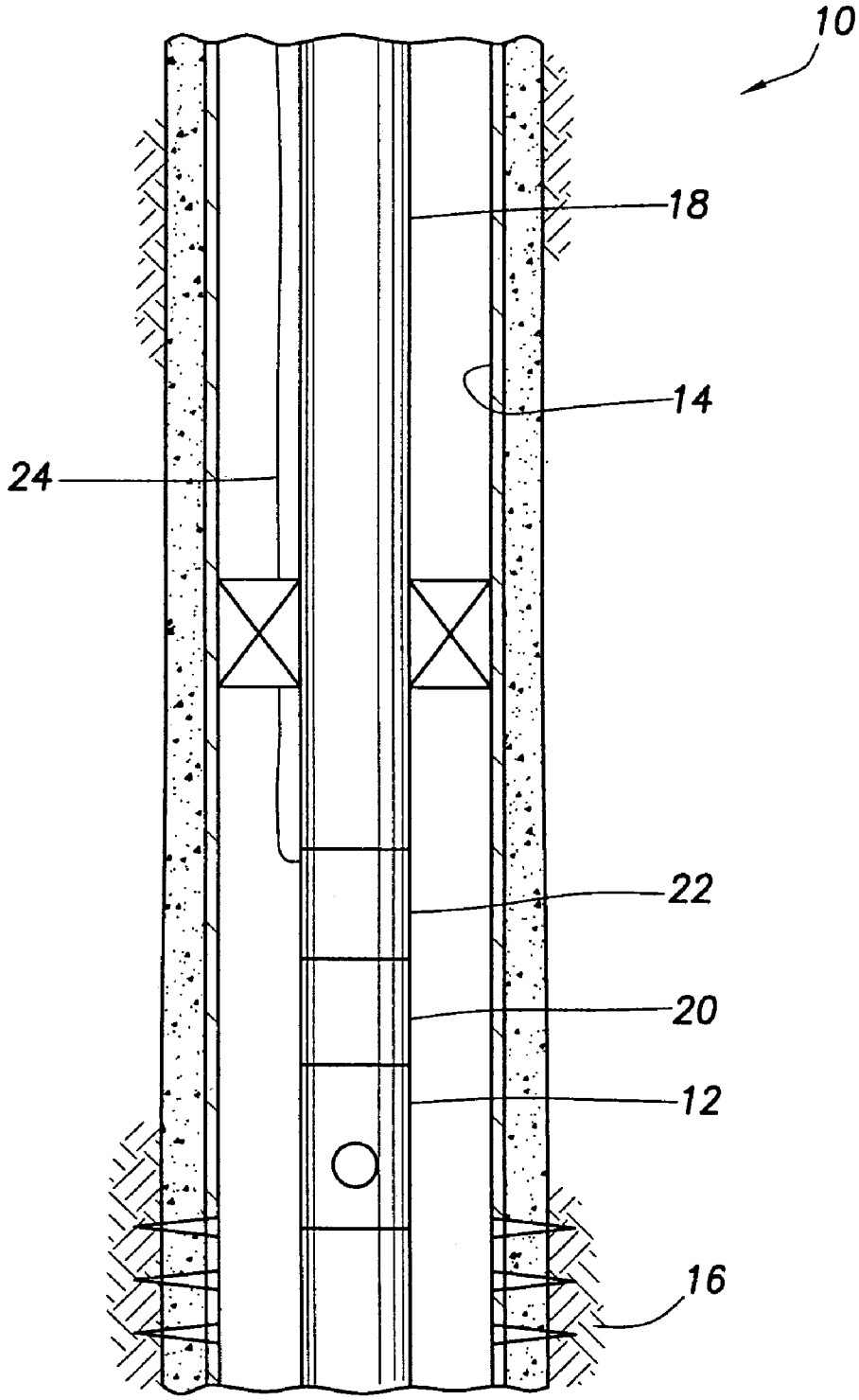
FIG. 1 is a schematic partially cross-sectional view of a hydraulically actuated control system as used in a subterranean well, the system embodying principles of the present invention.

Representatively illustrated in FIG. 1 is a control system 10 which embodies principles of the present invention. In the following description of the control system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, the control system 10 is used to control actuation of a well tool 12 positioned in a wellbore 14. The well tool 12 is representatively a choke used to regulate fluid flow between a formation 16 and the interior of a tubing string 18 in which the choke is interconnected. However, it should be clearly understood that the principles of the present invention may be used in conjunction with actuation of any type of well tool (including, but not limited to, valves, packers, test equipment, etc.).

An actuator 20 is provided for the well tool 12. The actuator 20 may be as simple as a piston in a bore, with the piston being connected to a closure member (or other operating member) of the well tool 12, so that displacement of the piston causes actuation of the well tool. If the well tool 12 is a choke, such as the Interval Control Valve marketed by WellDynamics of Spring, Tex., then incremental displacements of the piston may be used to incrementally adjust a rate of fluid flow through the choke. However, other types of actuators may be used without departing from the principles of the invention.

The control system 10 includes a control module 22 interconnected between the actuator 20 and fluid lines 24 extending to a remote location, such as the earth's surface or another location in the wellbore 14. The lines 24 may transmit hydraulic fluid between the control module 22 and the remote location, although other types of fluid may be transmitted through the lines 24, if desired.

Figure 2:
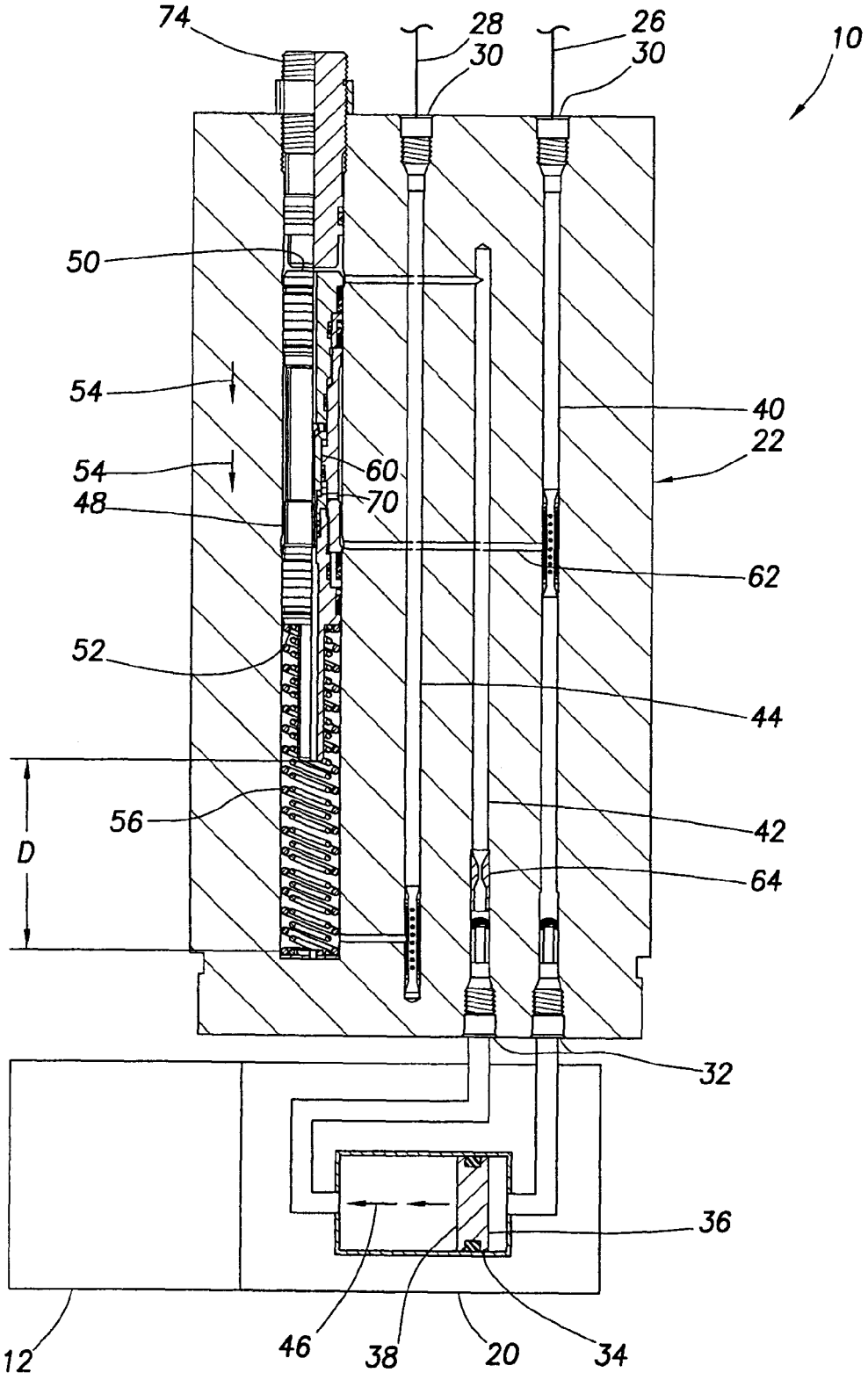
FIG. 2 is an enlarged scale hydraulic circuit diagram for the control system of FIG. 1, showing the control system in a first configuration.

Referring additionally now to FIG. 2, the control module 22, actuator 20 and well tool 12 are schematically and representatively illustrated. The lines 24 are separately illustrated as lines 26, 28 connected to ports 30 of the control module 22. The actuator 20 is connected to the control module 22 via additional ports 32.

Note that the actuator 20 includes a piston 34 having opposite sides 36, 38. The piston side 36 is in fluid communication with the line 26 via a fluid passage 40 extending through the control module 22. The other piston side 38 is in fluid communication with the other line 28 via additional passages 42, 44 extending in the control module 22.

When pressure is applied to the line 26, the control module 22 transmits this pressure to the piston 34 via the passage 40. Preferably, the lines 26, 28 are initially balanced, that is, at substantially the same pressure. Pressure applied to the line 26 would, thus, cause an increase in pressure on the line 26 relative to that on the line 28.

The piston 34 is displaced to the left as viewed in FIG. 2 and indicated by arrows 46, due to the pressure differential between the piston sides 36, 38 (in fluid communication with the lines 26, 28, respectively). Of course, as the piston 34 displaces to the left, it flows fluid from the actuator 20 into the passage 42 of the control module 22.

The control module 22 includes a piston 48 which is used to limit the volume of fluid transmitted from the actuator 20 into the control module 22 when the actuator piston 34 displaces to the left. The control module piston 48 has opposite sides 50, 52, which are in fluid communication with the passages 42, 44, respectively. As fluid flows from the actuator 20 into the passage 42 (due to displacement of the actuator piston 34 to the left), the corresponding fluid pressure is applied to the piston side 50, thereby biasing the control module piston 48 downward, as indicated by arrows 54.

As the control module piston 48 displaces downward, it displaces fluid into the passage 44, and thence to the line 28. Note that the control module piston 48 is biased downward due to a differential between pressure on the piston side 50 and pressure on the piston side 52. A biasing device 56 (representatively illustrated as concentric coiled compression springs) biases the control module piston 48 upwardly, so that the pressure differential between the piston sides 50, 52 must be sufficiently great to overcome the upwardly biasing force exerted on the piston by the biasing device, in order to displace the piston downwardly.

The control module piston 48 can only displace downwardly a predetermined distance D, at which point the piston will come to the end of its stroke. When the piston 48 displaces the distance D, a corresponding predetermined volume of fluid is displaced by the piston into the passage 44 and thence into the line 28. Since the control module piston 48 can only displace the distance D, it will be readily appreciated that the actuator piston 34 can only displace a certain corresponding distance. That is, the actuator piston 34 can only displace to the left a distance which will flow a volume of fluid through the passage 42 sufficient to displace the control module piston 48 downward the distance D.

An adjustable stop 74 permits the distance D to be varied. This adjustment capability permits the system 10 to be used with different well tools for which corresponding different volumes of fluid may be desired to actuate the well tools in response to each displacement of the control module piston 48. Representatively, the adjustable stop 74 is threaded a greater or lesser distance into the control module 22 to vary the distance D, although other types of adjustments may be used, if desired.

Figure 3:
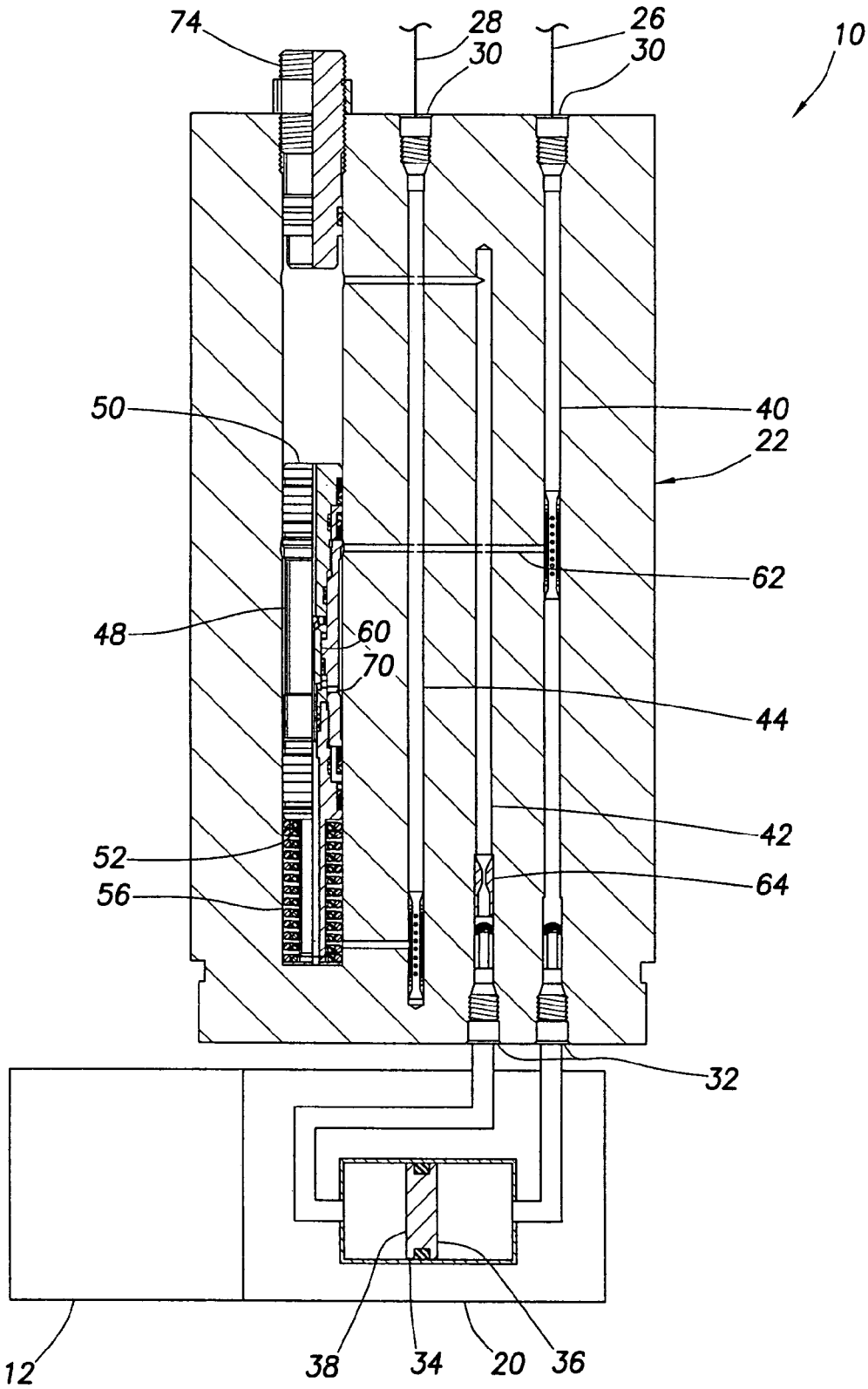
FIG. 3 is an enlarged scale hydraulic circuit diagram for the control system of FIG. 1, showing the control system in a second configuration.

Referring additionally now to FIG. 3, the system 10 is representatively illustrated after the control module piston 48 has been displaced to the end of its stroke. Note that the actuator piston 34 has displaced a corresponding distance to the left.

If, at this point, further pressure is applied to the line 26, the actuator piston 34 will not displace further, since flow from the actuator 20 through the passage 42 is prevented by the control module piston 48, which is at the end of its stroke. This is very beneficial, in that a known incremental displacement of the actuator piston 34 may be obtained in response to an application of pressure to the line 26. For example, if the well tool 12 is a choke, this known displacement of the actuator piston 34 may be used to produce a corresponding adjustment to the rate of fluid flow through the choke.

Figure 4:
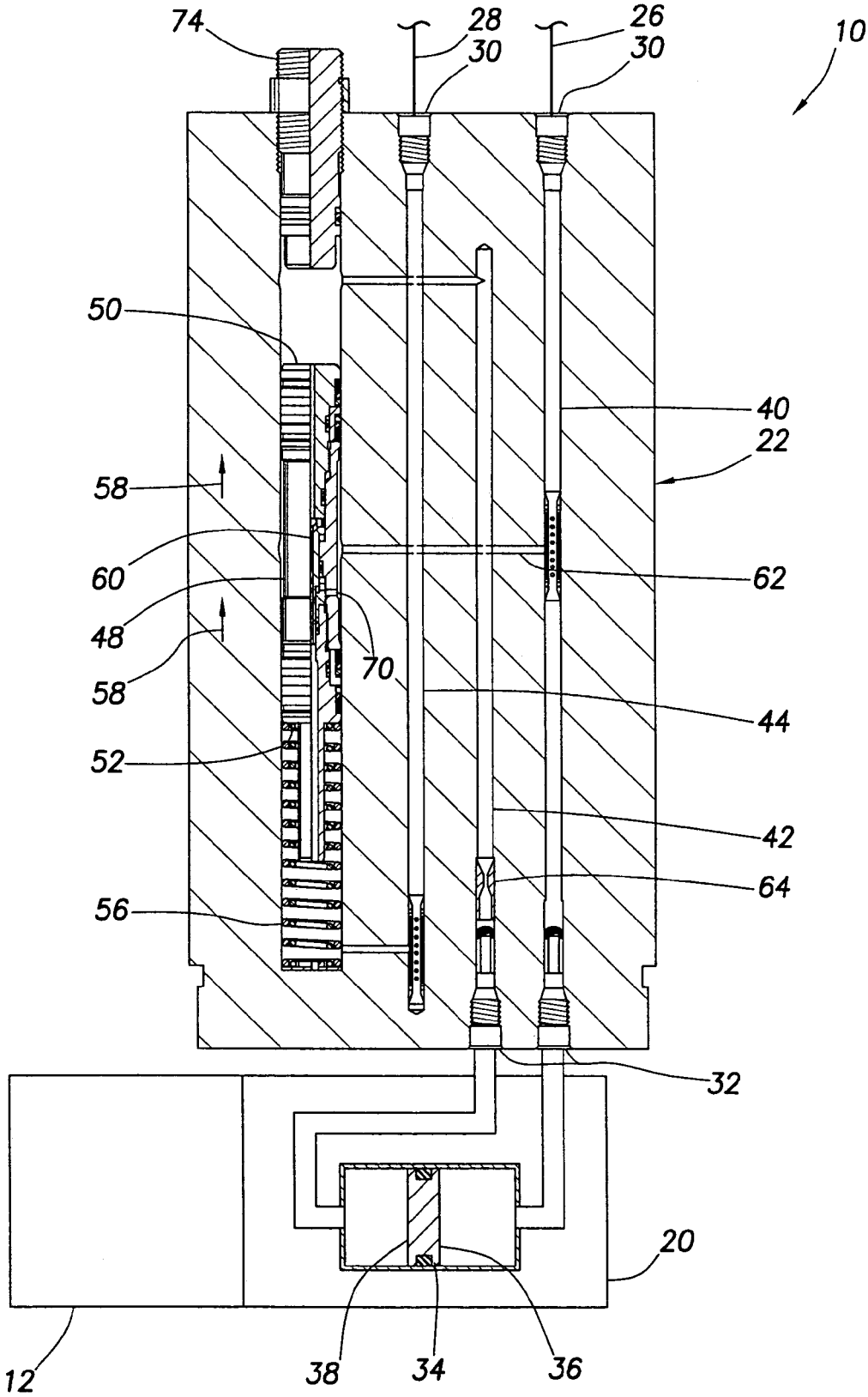
FIG. 4 is an enlarged scale hydraulic circuit diagram for the control system of FIG. 1, showing the control system in a third configuration.

Referring additionally now to FIG. 4, the control system 10 is representatively illustrated after the pressure applied to the line 26 has been reduced. As soon as the differential pressure applied across the sides 50, 52 of the control module piston 48 is reduced sufficiently, the biasing device 56 displaces the piston upward, as indicated by arrows 58. However, note that the actuator piston 34 does not displace when the control module piston 48 displaces upward, because a valve 60 in the control module piston permits flow between the sides 50, 52 of the control module piston.

When pressure in the line 26 is increased (as depicted in FIG. 2), the valve 60 closes, preventing fluid flow from the side 50 to the side 52 of the control module piston 48. The valve 60 is of the type known to those skilled in the art as a pilot-operated valve, in that pressure applied to a pilot port 70 closes the valve. Pressure is applied to the port 70 when pressure in the line 26 is increased, due to a passage 62 formed in the control module 22 between the passage 40 and the port 70. Increased pressure in the passage 62 operates to force the valve 60 to its closed configuration, thereby preventing fluid from flowing from the passage 42 to the passage 44 through the control module piston 48.

For further assurance that fluid flowed from the actuator 20 into the passage 42 does not flow through the valve 60 when pressure in the line 26 is increased, a flow restrictor 64 is installed in the passage 42. The flow restrictor 64 retards the increase in pressure on the side 50 of the control module piston 48 as compared to the increase in pressure at the port 70 via the passage 62.

It may now be fully appreciated that the control module 22 permits the actuator piston 34 to be incrementally displaced in response to repeated applications of pressure to the line 26. When pressure in the line 26 is increased, the actuator piston 34 displaces a predetermined distance to the left, and the control module piston 48 displaces downward the distance D, thereby displacing the predetermined volume of fluid into the line 28. When pressure in the line 26 is reduced, the control module piston 48 displaces upward the distance D (due to the force exerted by the biasing device 56), thereby "recocking" the control module 22. When pressure in the line 26 is again increased, the actuator piston 34 will again displace incrementally to the left. This process may be repeated as many times as needed to displace the actuator piston 34 a desired distance, to thereby actuate the well tool 12 incrementally.

When it is desired to actuate the well tool 12 by displacing the actuator piston 34 to the right (for example, to open a choke or valve, etc.), pressure in the line 28 may be increased. This increased pressure in the line 28 will cause fluid to flow through the passage 44, through the control module piston 48 via the open valve 60, through the passage 42, and to the actuator 20. A pressure differential from the side 38 to the side 36 of the actuator piston 34 will cause fluid to flow from the actuator 20 through the passage 40 and into the line 26. Thus, the actuator piston 34 may be displaced all the way to the right in response to a single increase in pressure on the line 28.

Figure 5:
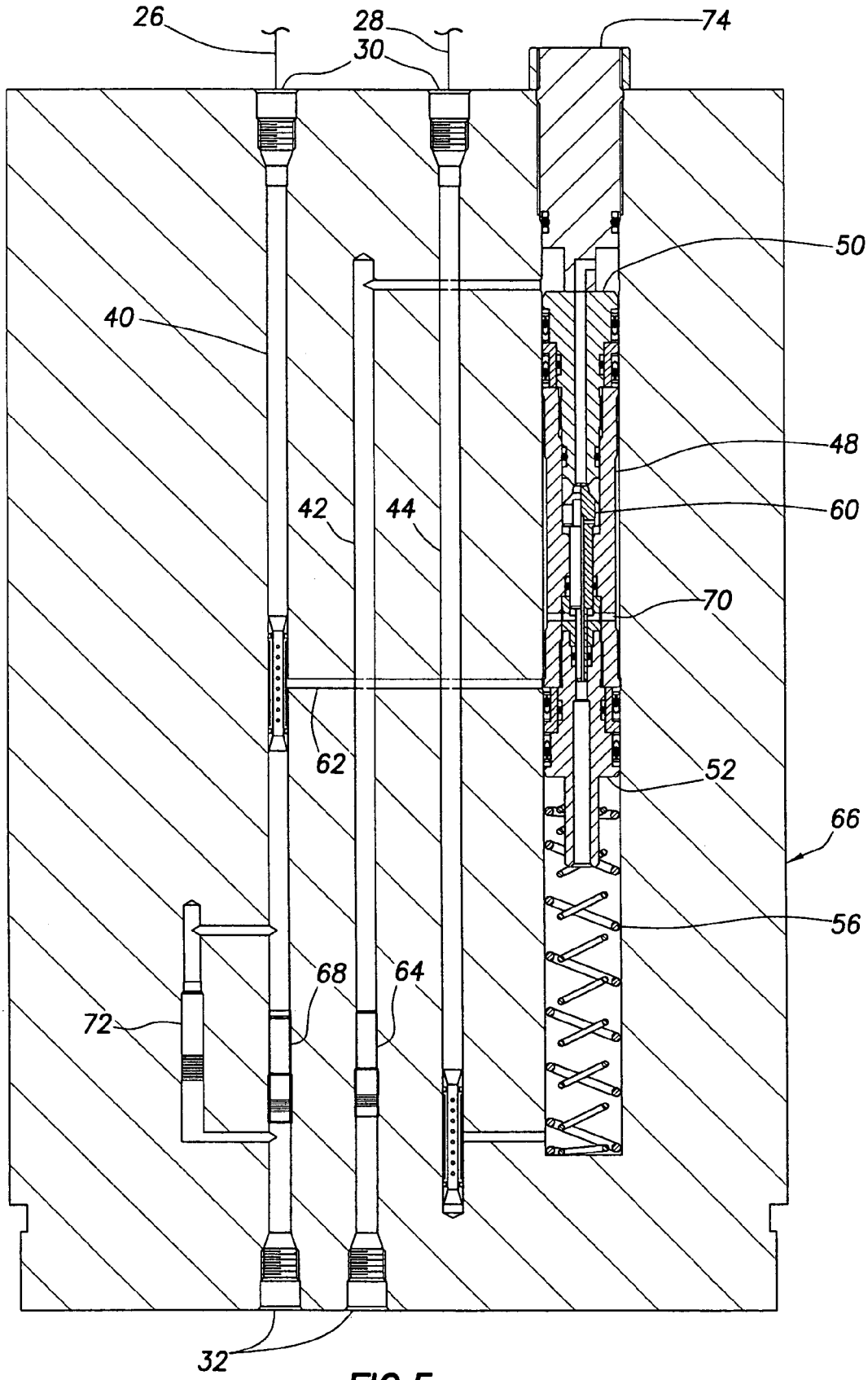
FIG. 5 is an enlarged scale hydraulic circuit diagram for another control system embodying principles of the invention.

Referring additionally now to FIG. 5, another embodiment of a control module 66 is representatively illustrated. The control module 66 may be used in place of the control module 22 in the system 10 described above. Since the control module 66 is similar in many respects to the control module 22, the same reference numbers are used in FIG. 5 to indicate similar elements. Of course, the control module 66 may be used in other systems, and may be differently configured, without departing from the principles of the invention.

The control module 66 includes a pressure relief valve 68 installed in the passage 40. Representatively, the relief valve 68 is designed to open when 1,000 psi has been applied to the line 26 (that is, a pressure differential of 1,000 psi across the relief valve). Of course, other relief pressures may be used, if desired.

Note that the relief valve 68 is positioned in the passage 40 between its intersection with the passage 62 and the port 32 to the actuator 20. Thus, pressure in the passage 62 will increase prior to the pressure being transmitted through the relief valve 68 to the actuator 20, thereby ensuring that the valve 60 is closed before the actuator piston 34 displaces fluid from the actuator to the passage 42 of the control module 66.

However, since it is also desired to flow fluid from the actuator 20 to the line 26 via the passage 40 when pressure in the line 28 is increased (to displace the actuator piston 34 in an opposite direction, as described above), a check valve 72 is installed in parallel with the relief valve 68 in the passage 40. The check valve 72 permits flow from the actuator 20 to the line 26 via the passage 40, but prevents flow through the check valve in the opposite direction.

Thus, when pressure in the line 26 is increased, the check valve 72 is closed and the relief valve 68 prevents the increased pressure from being transmitted to the actuator 20 until a predetermined pressure level is reached. When pressure in the other line 28 is increased, the check valve 72 opens, thereby permitting flow from the actuator 20 to the line 26.

Note that the relief valve 68 and check valve 72 are not necessary in keeping with the principles of the invention. For example, the relief valve 68 and check valve 72 could be replaced with a restrictor, such as the restrictor 64.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A control system for use in a subterranean well, the system comprising:

a well tool;

an actuator for the well tool; and a control module interconnected between the actuator and first and second fluid lines, the control module being operative to meter a predetermined volume of fluid from the actuator to the second line in response to an increased pressure differential from the first line to the second line, and wherein the control module transmits fluid from the first line to the actuator in response to the increased pressure differential.

2. A control system for use in a subterranean well, the system comprising:

a well tool;

an actuator for the well tool; and a control module interconnected between the actuator and first and second fluid lines, the control module being operative to meter a predetermined volume of fluid from the actuator to the second line in response to an increased pressure differential from the first line to the second line, and wherein a piston of the control module displaces a predetermined distance, thereby displacing the predetermined volume of fluid to the second line, in response to the increased pressure differential.

3. A control system for use in a subterranean well, the system comprising:

a well tool;

an actuator for the well tool; and a control module interconnected between the actuator and first and second fluid lines, the control module being operative to meter a predetermined volume of fluid from the actuator to the second line in response to an increased pressure differential from the first line to the second line, and wherein a valve of the control module controlling fluid flow between the actuator and the second line closes in response to the increased pressure differential.

4. The system according to claim 3, wherein the valve controls fluid flow between opposite sides of a piston of the control module.

5. The system according to claim 4, wherein closure of the valve permits the piston to displace a predetermined distance, thereby displacing the predetermined volume of fluid to the second line, in response to the increased pressure differential.

6. A control system for use in a subterranean well, the system comprising:

a well tool;

an actuator for the well tool; and a control module interconnected between the actuator and first and second fluid lines, the control module being operative to meter a predetermined volume of fluid from the actuator to the second line in response to an increased pressure differential from the first line to the second line, and wherein the control module prevents pressure applied to the first line from being communicated to the actuator until the pressure differential reaches a predetermined level.

7. A control system for use in a subterranean well, the system comprising:

a well tool;

an actuator for the well tool; and a control module interconnected between the actuator and first and second fluid lines, the control module being operative to meter a predetermined volume of fluid from the actuator to the second line in response to an increased pressure differential from the first line to the second line, and wherein the control module permits pressure applied to the second line to be transmitted to the actuator, and from the actuator to the first line, without metering flow from the actuator to the first line.

8. A control system for use in a subterranean well, the system comprising:

a well tool;

an actuator for the well tool; and a control module interconnected between the actuator and first and second fluid lines, the control module being operative to meter a predetermined volume of fluid from the actuator to the second line in response to an increased pressure differential from the first line to the second line, and wherein the control module is operative to repeatedly meter the predetermined volume of fluid from the actuator to the second line in response to respective successive increases in the pressure differential.

9. The system according to claim 8, wherein the actuator incrementally actuates the well tool in response to each metering of the predetermined volume of fluid from the actuator to the second line.

10. A control system for use in a subterranean well, the system comprising:

a well tool;

an actuator including an actuator piston which displaces to operate the well tool; and a control module interconnected between the actuator and first and second fluid lines, a pressure differential from the first line to the second line being operative to displace the actuator piston and operate the well tool, and the control module being operative to meter a predetermined volume of fluid from the actuator to the second line, to thereby limit displacement of the actuator piston in response to each of multiple increases in the pressure differential from the first line to the second line.

11. The control system according to claim 10, wherein the control module includes a pressure relief valve interconnected between the first line and the actuator.

12. The control system according to claim 11, wherein the control module includes a check valve permitting flow therethrough from the actuator to the first line and preventing flow therethrough from the first line to the actuator.

13. The control system according to claim 12, wherein the check valve is in parallel with the pressure relief valve.

14. The control system according to claim 10, wherein the control module prevents pressure from being transmitted from the first line to the actuator until the pressure differential reaches a predetermined level.

15. The control system according to claim 14, wherein the control module permits relatively unrestricted flow from the actuator to the first line.

16. The control system according to claim 10, wherein the control module provides greater restriction to flow between the second line and the actuator than between the first line and the actuator.

17. The control system according to claim 10, wherein the control module includes a control module piston having first and second opposite sides, the first side being in fluid communication with the actuator, and the second side being in fluid communication with the second line.

18. The control system according to claim 17, wherein the control module piston displaces a predetermined distance in response to pressure applied from the actuator to the first side, to thereby meter the predetermined volume of fluid from the actuator to the second line.

19. The control system according to claim 18, wherein pressure applied from the actuator to the first side displaces the control module piston against a force exerted by a biasing device of the control module.

20. The control system according to claim 18, wherein the control module includes a valve selectively permitting and preventing flow between the first and second sides of the control module piston.

21. The control system according to claim 20, wherein the pressure differential operates to close the valve.

22. A method of controlling actuation of a well tool, the method comprising the steps of:

interconnecting a control module between first and second fluid lines and an actuator of the well tool;

increasing a pressure differential from the first line to the second line, the control module transmitting the pressure differential to the actuator;

metering a predetermined volume of fluid from the actuator to the second line via the control module in response to the pressure differential increasing step, thereby incrementally actuating the well tool; and repeating the pressure differential increasing and metering steps, thereby successively incrementally actuating the well tool.

23. The method according to claim 22, wherein the pressure differential increasing step further comprises preventing flow from the first line to the actuator until a predetermined differential pressure is reached from the first line to the second line.

24. The method according to claim 22, wherein the pressure differential increasing step further comprises closing a valve of the control module interconnected between the actuator and the second line.

25. The method according to claim 22, wherein the metering step further comprises displacing a piston of the control module a predetermined distance in response to a pressure differential between the actuator and the second line.

26. The method according to claim 25, wherein the pressure differential increasing step further comprises closing a valve of the control module, thereby preventing flow between opposite sides of the piston.

27. The method according to claim 26, wherein the valve closing step further comprises closing the valve in response to a differential between pressure in the first line and pressure applied to the piston from the actuator.

28. The method according to claim 27, wherein the valve closing step further comprises restricting flow from the actuator to the piston, thereby increasing the differential between pressure in the first line and pressure applied to the piston from the actuator.

29. The method according to claim 22, further comprising the step of applying pressure to the second line, the control module transmitting pressure applied to the second line to the actuator, without metering fluid flow from the second line to the actuator.

* * * * *